US011095975B2

(12) United States Patent
Zastoupil et al.

(10) Patent No.: US 11,095,975 B2
(45) Date of Patent: Aug. 17, 2021

(54) LINE ARRAY LOUDSPEAKER

(71) Applicant: Bose Corporation, Framingham, MA (US)

(72) Inventors: Greg Zastoupil, North Grafton, MA (US); Joseph John Kutil, III, Franklin, MA (US); Peter C. Santoro, Groton, MA (US)

(73) Assignee: Bose Corporation, Framingham, MA (US)

( * ) Notice: Subject to any disclaimer, the term of this patent is extended or adjusted under 35 U.S.C. 154(b) by 79 days.

(21) Appl. No.: 16/542,393

(22) Filed: Aug. 16, 2019

(65) Prior Publication Data

US 2021/0051398 A1 Feb. 18, 2021

(51) Int. Cl.
*H04R 1/40* (2006.01)
*H04R 3/12* (2006.01)
*H04R 1/02* (2006.01)

(52) U.S. Cl.
CPC ..... *H04R 1/403* (2013.01); *H04R 1/025* (2013.01); *H04R 3/12* (2013.01); *H04R 2201/403* (2013.01)

(58) Field of Classification Search
CPC ..... H04R 1/403; H04R 1/025; H04R 3/12; H04R 2201/403
See application file for complete search history.

(56) References Cited

U.S. PATENT DOCUMENTS 3,125,181 A 3/1964 Pawlowski
4,223,760 A 9/1980 Letourneau
4,940,108 A 7/1990 Selby
5,309,518 A * 5/1994 Ickler ..... H04R 1/2819 181/144
7,826,622 B2 11/2010 Keele, Jr.
(Continued)

FOREIGN PATENT DOCUMENTS

EP 0649269 A1 4/1995

OTHER PUBLICATIONS

The International Search Report and The Written Opinion of the International Searching Authority dated Oct. 23, 2020 for PCT Application No. PCT/US2020/045301.

*Primary Examiner* — Brian Ensey
(74) *Attorney, Agent, or Firm* — Brian M. Dingman; Dingman IP Law, PC

(57) ABSTRACT

A line array loudspeaker has a first group of acoustic drivers comprising a first plurality of acoustic drivers each comprising an axis, the first plurality of acoustic drivers arranged so that their axes are parallel. There is a second plurality of acoustic drivers each comprising an axis, the second plurality of acoustic drivers arranged so that their axes are parallel. The first and second plurality of acoustic drivers are arranged such that a projection onto an azimuth plane of the axes of the first plurality of acoustic drivers intersects with a projection onto the azimuth plane of the axes of the second plurality of acoustic drivers at a first, fixed articulation angle. There is a second group of acoustic drivers that is adjacent to the first group. The second group comprises a third plurality of acoustic drivers each comprising an axis. The drivers of the second group are arranged such that a projection onto the azimuth plane of the axes of the third plurality of acoustic drivers intersect at varied articulation angles.

17 Claims, 6 Drawing Sheets

(56) References Cited

U.S. PATENT DOCUMENTS

| | | | | |
|---|---|---|---|---|
| 7,936,891 | B2 * | 5/2011 | Henricksen | H04R 1/403<br>381/335 |
| 8,126,180 | B2 | 2/2012 | Jacob et al. | |
| 8,995,695 | B2 | 3/2015 | Ohashi et al. | |
| 9,033,098 | B2 * | 5/2015 | Bridge | H04R 31/006<br>181/199 |
| 10,063,948 | B2 * | 8/2018 | Kutil | H04R 1/00 |
| 2008/0085026 | A1 | 4/2008 | Engebretson et al. | |
| 2009/0103753 | A1 | 4/2009 | Hsu | |
| 2018/0132034 | A1 | 5/2018 | Burette et al. | |

* cited by examiner

LINE ARRAY LOUDSPEAKER

BACKGROUND

This disclosure relates to a line array loudspeaker.

Line array loudspeakers are known, for example as disclosed in U.S. Pat. No. 7,936,891, the disclosure of which is incorporated herein by reference for all purposes. Line array loudspeakers include a number of acoustic drivers in an array. Typically the array is generally linear. In some cases the drivers are articulated. That is, the drivers do not all radiate in the same direction. If the articulation angle (i.e., the angle between the axes of the drivers) is wide, listeners who are close to the array may hear one driver more than other drivers. In the extreme, when a listener is in the near field and located off-axis of any driver, the magnitude of the sound can be diminished.

SUMMARY

All examples and features mentioned below can be combined in any technically possible way.

In one aspect, a line array loudspeaker includes a first group of acoustic drivers comprising a first plurality of acoustic drivers each comprising an axis, the first plurality of acoustic drivers arranged so that their axes are parallel. There is a second plurality of acoustic drivers each comprising an axis, the second plurality of acoustic drivers arranged so that their axes are parallel. The first and second plurality of acoustic drivers are arranged such that a projection onto an azimuth plane of the axes of the first plurality of acoustic drivers intersects with a projection onto the azimuth plane of the axes of the second plurality of acoustic drivers at a first, fixed articulation angle. There is a second group of acoustic drivers that is adjacent to the first group and comprises a third plurality of acoustic drivers each comprising an axis. A projection onto the azimuth plane of the axes of the third plurality of acoustic drivers intersect at varied articulation angles.

Examples may include one of the above and/or below features, or any combination thereof. The first and second plurality of acoustic drivers may be interleaved along a length of the first group of acoustic drivers. The projections onto the azimuth plane of the axes of a first pair of acoustic drivers of the second group of acoustic drivers may intersect at a second articulation angle that is different than the first articulation angle. The projections onto the azimuth plane of the axes of a second pair of acoustic drivers of the second group of acoustic drivers may intersect at a third articulation angle that is different than both the first and second articulation angles. The first pair of acoustic drivers of the second group of acoustic drivers may be the closest acoustic drivers of the second group to the first group. The second pair of acoustic drivers of the second group of acoustic drivers may be adjacent to the first pair of acoustic drivers of the second group of acoustic drivers. The third articulation angle may be less than both the first and second articulation angles. The second articulation angle may be less than the first articulation angle.

Examples may include one of the above and/or below features, or any combination thereof. The second group of acoustic drivers may be arranged along a curved line. The curved line may have a constant radius of curvature. The first group of acoustic drivers may be arranged along the same curved line as is the second group of acoustic drivers. The curved line may be continuously curved. The curvature may increase continuously along an entire length of the line array.

Examples may include one of the above and/or below features, or any combination thereof. At least some of the acoustic drivers of the first and second groups of acoustic drivers may be configured to be positioned such that an angle of their axes relative to horizontal can be changed. The axes of the first plurality of acoustic drivers may be coplanar in a first plane and the axes of the second plurality of acoustic drivers may be coplanar in a second plane. The first and second planes may intersect at a plane intersection angle. The plane intersection angle may be an acute angle. The acoustic drivers may each be configured to output sound with an amplitude and phase, and the line array loudspeaker may further comprise a processor that is configured to alter at least one of the amplitude and phase of the sound from a plurality of the acoustic drivers.

In another aspect, a line array loudspeaker includes a first group of acoustic drivers comprising a first plurality of acoustic drivers each comprising an axis, the first plurality of acoustic drivers arranged so that their axes are parallel, and a second plurality of acoustic drivers each comprising an axis, the second plurality of acoustic drivers arranged so that their axes are parallel. The first and second plurality of acoustic drivers are arranged such that a projection onto an azimuth plane of the axes of the first plurality of acoustic drivers intersects with a projection onto the azimuth plane of the axes of the second plurality of acoustic drivers at a first, fixed articulation angle. The first and second plurality of acoustic drivers are interleaved along a length of the first group of acoustic drivers. A second group of acoustic drivers is adjacent to the first group and comprises a third plurality of acoustic drivers each comprising an axis. A projection onto the azimuth plane of the axes of the third plurality of acoustic drivers intersect at varied articulation angles. The projections onto the azimuth plane of the axes of a first pair of acoustic drivers of the second group of acoustic drivers intersect at a second articulation angle that is less than the first articulation angle, and the projections onto the azimuth plane of the axes of a second pair of acoustic drivers of the second group of acoustic drivers intersect at a third articulation angle that is less than both the first and second articulation angles. The first pair of acoustic drivers of the second group of acoustic drivers are the closest acoustic drivers of the second group to the first group and the second pair of acoustic drivers of the second group of acoustic drivers is adjacent to the first pair of acoustic drivers of the second group of acoustic drivers.

Examples may include one of the above and/or below features, or any combination thereof. The second group of acoustic drivers may be arranged along a curved line that has a constant radius of curvature. The first group of acoustic drivers may be arranged along a straight line.

DETAILED DESCRIPTION

A line array loudspeaker has a first group of acoustic drivers comprising a first plurality of acoustic drivers each comprising an axis, the first plurality of acoustic drivers arranged so that their axes are parallel. There is a second plurality of acoustic drivers each comprising an axis, the second plurality of acoustic drivers arranged so that their axes are parallel. The first and second plurality of acoustic drivers are arranged such that a projection onto an azimuth plane of the axes of the first plurality of acoustic drivers intersects with a projection onto the azimuth plane of the axes of the second plurality of acoustic drivers at a first, fixed articulation angle. There is a second group of acoustic drivers that is adjacent to the first group. The second group comprises a third plurality of acoustic drivers each comprising an axis. The drivers of the second group are arranged such that a projection onto the azimuth plane of the axes of the third plurality of acoustic drivers intersect at varied articulation angles. The second group of drivers may have articulation angles that are less than the articulation angles of the first group. The second group of drivers provides more consistent sound coverage in the near field, close to the line array. For venues in which audience members can sit close to a stage, the second group of drivers can be pointed toward the front rows so as to provide good sound quality at an appropriate loudness.

Figure 1A:
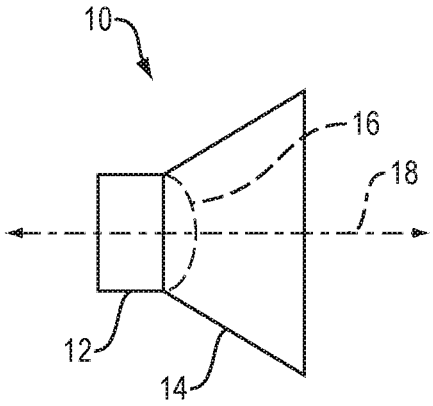
FIG. 1A is a side view and FIG. 1B is a front view of an acoustic driver.
Figure 1B:
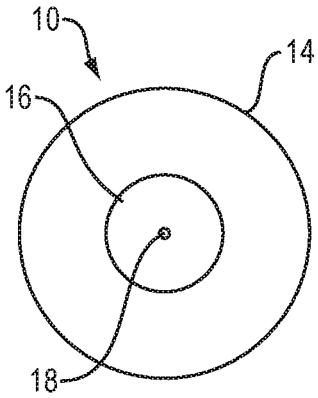

FIGS. 1A and 1B illustrate some aspects of an acoustic driver. Acoustic driver 10 includes a motor structure 12 that is configured to move pressure wave radiating component 14 back and forth along the axis of motion 18 of radiating surface 14. This motion generates sound pressure. Radiating surface 14 may be generally conical as shown, but need not be. The acoustic drivers may or may not have a dust cover 16. Acoustic drivers and different configurations of acoustic drivers are well known in the technical field and so are not fully described herein.

Figure 2:
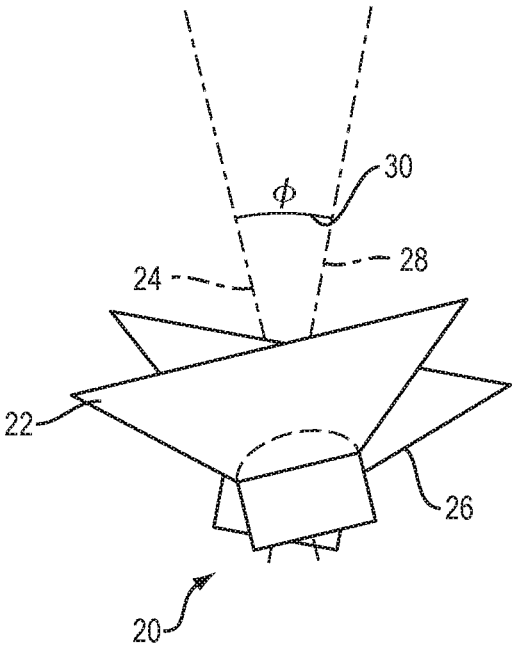
FIG. 2 is a top view of two articulated drivers of a line array loudspeaker.

FIG. 2 is a top view of one pair 20 of articulated acoustic drivers 22 and 26 that are part of a line array loudspeaker. Driver 22 has axis 24 and driver 26 has axis 28. Because the two drivers are articulated (i.e., their axes are not parallel), axes 24 and 28 lie at an angle 30, designated as Φ. In typical prior art line array loudspeakers this angle is fixed along the length of the array. In some examples, the axes of a first plurality of drivers of the linear array are pointed in the same direction and so the axes are co-planar in a first plane. The axes of a second plurality of drivers of the linear array are pointed in the same direction, but in a different direction than the first plurality of drivers. The axes of the second plurality of drivers are thus also co-planar, but in a second plane that intersects the first plane at what can be termed an articulation angle. Typically the drivers are interleaved, such that a driver of the second plurality of drivers lies between each two drivers of the first plurality of drivers. In one particular prior art line array loudspeaker, angle Φ is about 42 degrees. When such an array is located on a performance stage, the drivers may act as individual sources. Depending in part on the articulation angle, the sound pattern may not be consistent when a listener close to the array (in the near field) is located on-axis (e.g., in front of the array when none of the drivers are pointed directly forward), as compared to off axis. Listeners who are close to the array may hear one driver more than other drivers. In the extreme, when a listener is in the near field and located on-axis, the magnitude of the sound can be diminished because there is no driver directed at the listener.

Figure 3:
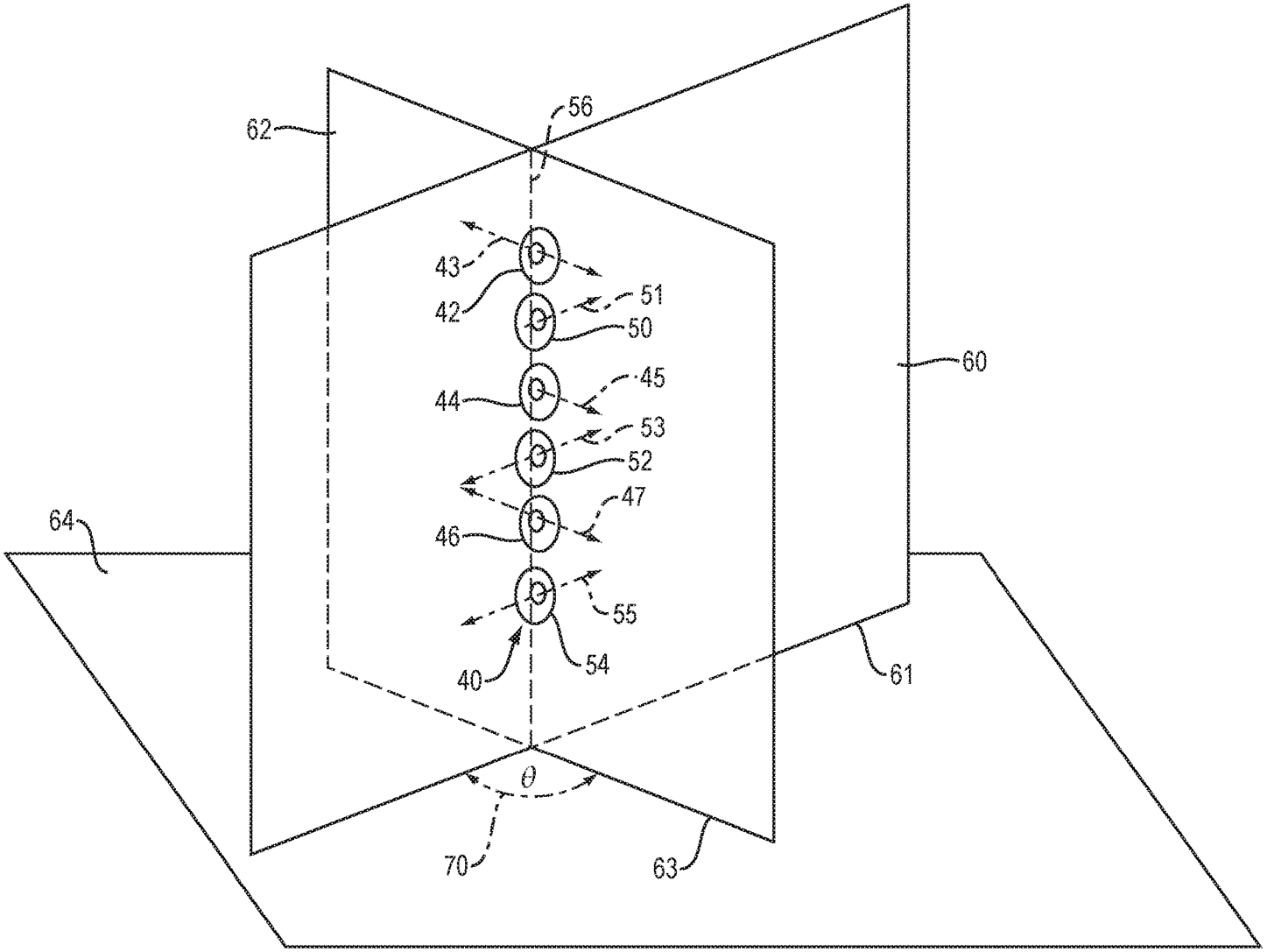
FIG. 3 is a schematic representation of a line array loudspeaker.

A first group 40 of acoustic drivers of a line array loudspeaker are schematically depicted in FIG. 3. In this non-limiting example all of the drivers (from top to bottom—drivers 42, 50, 44, 52, 46, and 54) are arranged along straight line 56. However, the drivers could be arranged in other manners, for example they could be arranged along a curved line, or partially along a straight line and partially along a curved line. Different arrangements of the drivers are further explained below.

Group 40 includes a first plurality of drivers 42, 44, and 46 with axes 43, 45, and 47 that lie in plane 62. The azimuthal projection of these axes (i.e., plane 62) intersects azimuthal plane 64 along line 63. Group 40 also includes a second plurality of drivers 50, 52, and 54 with axes 51, 53, and 55 that lie in plane 60. The azimuthal projection of these axes (i.e., plane 60) intersects azimuthal plane 64 along line 61. Lines 61 and 63 meet at an angle 70, designated as Θ. Angle 70 is a fixed articulation angle of the transducers making up first group 40. Angle 70 is preferably but not necessarily an acute angle.

Figure 4A:
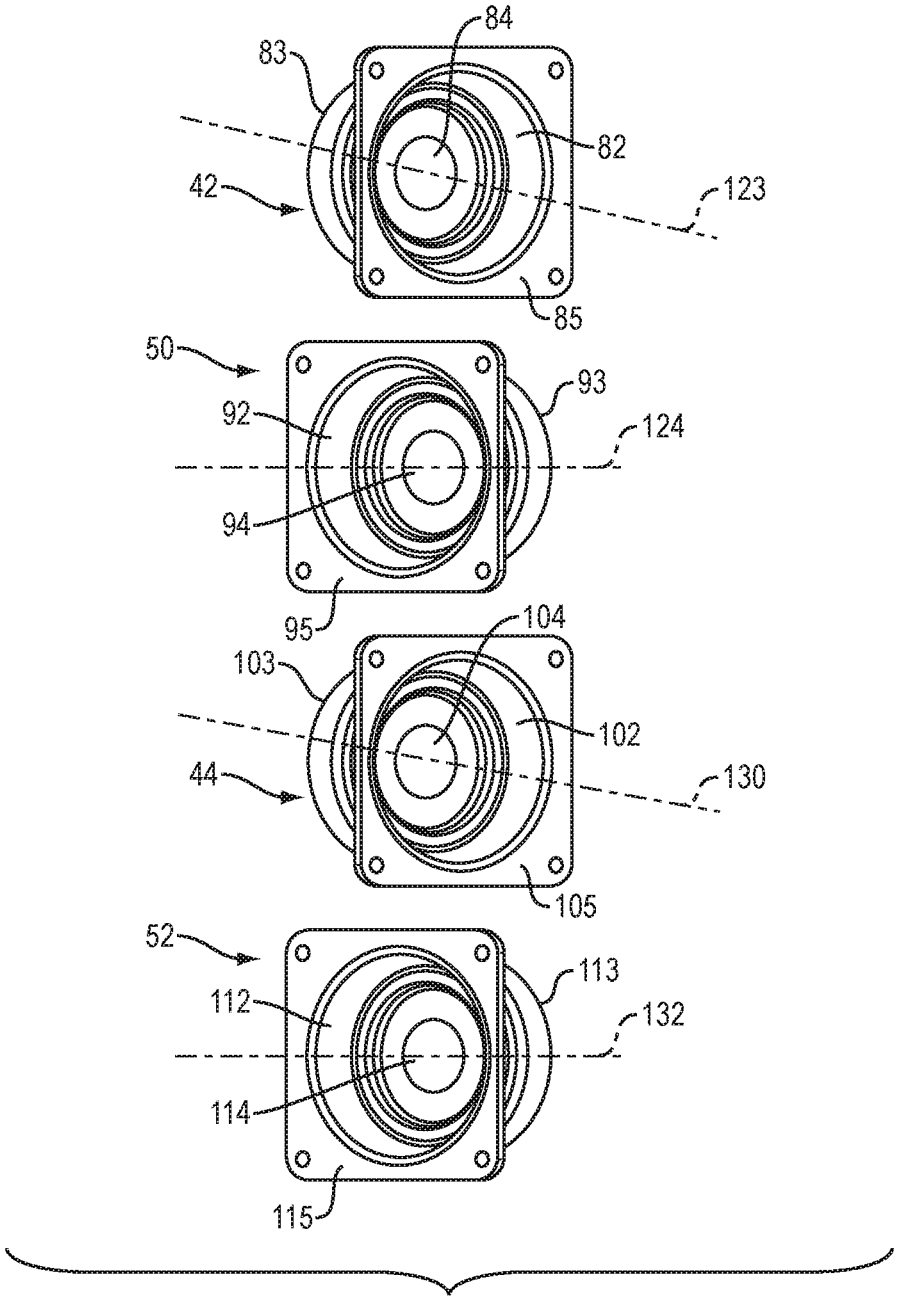
FIG. 4A shows a first group of acoustic drivers for a line array loudspeaker.

FIG. 4A shows drivers 42, 50, 44, and 52 in more detail. Motor structure 83 moves radiating surface 82 of driver 42 along driver axis 123. Dust cap 84 may be included. Mounting flange 85 is a structure that is used to mount the driver to a loudspeaker housing; see FIG. 4B. Similarly, motor structure 93 moves radiating surface 92 of driver 50 along driver axis 124. Dust cap 94 may be included. Mounting flange 95 is a structure that is used to mount the driver to a loudspeaker housing. Similarly, motor structure 103 moves radiating surface 102 of driver 44 along driver axis 130. Dust cap 104 may be included. Mounting flange 105 is a structure that is used to mount the driver to a loudspeaker housing. Similarly, motor structure 113 moves radiating surface 112 of driver 52 along driver axis 132. Dust cap 114 may be included. Mounting flange 115 is a structure that is used to mount the driver to a loudspeaker housing.

Figure 4B:
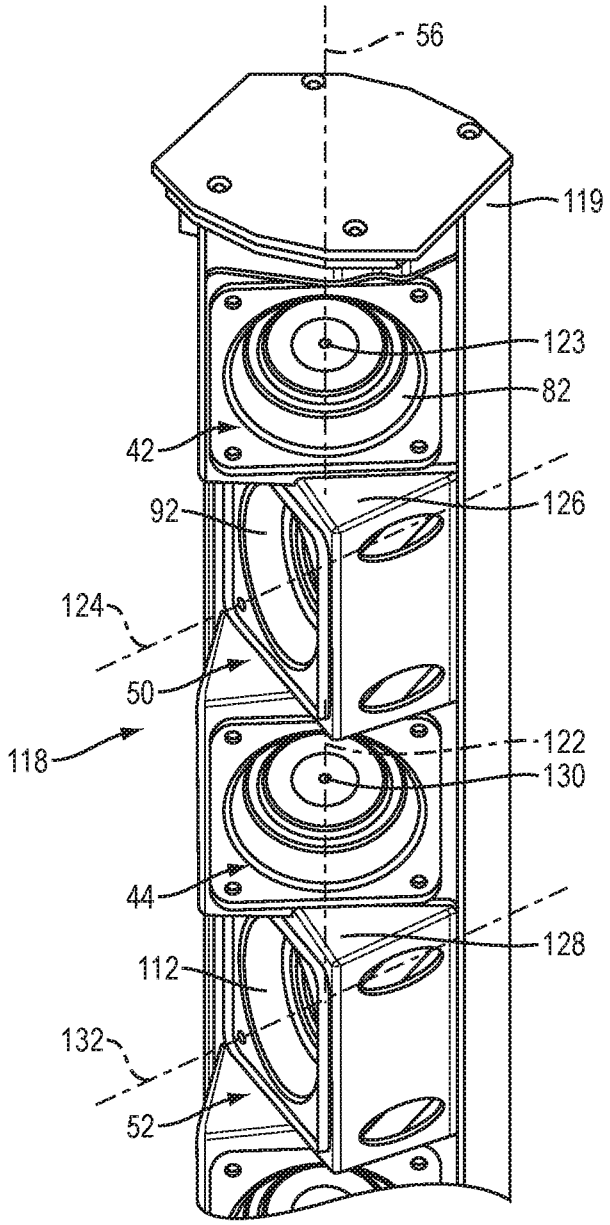
FIG. 4B illustrates part of a line array loudspeaker that includes the first group of acoustic drivers of FIG. 4A.
Figure 5:
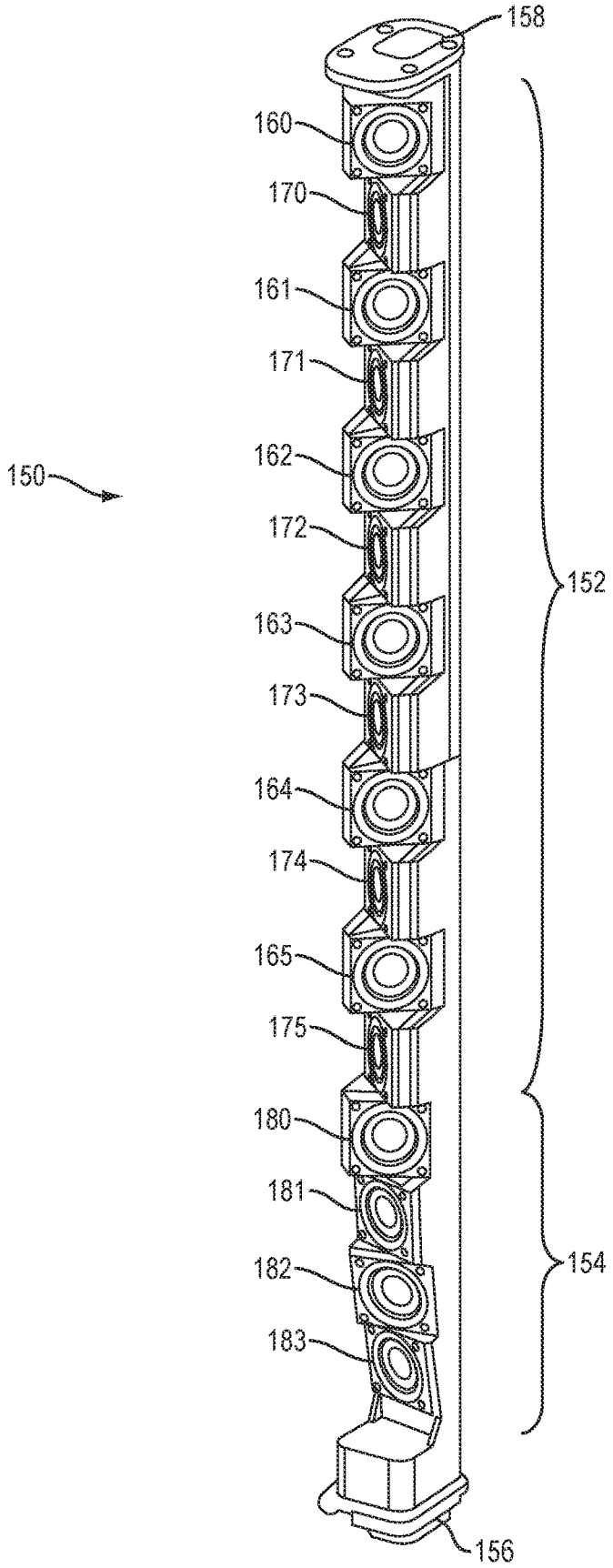
FIG. 5 is a perspective view of a line array loudspeaker.

FIG. 4B illustrates assembly 118 which includes a loudspeaker housing structure 119 that holds the drivers in place in a linear array, with the drivers spaced apart along line 56 (which in this non-limiting example passes through the dust caps of the drivers). Also shown are optional individual driver mounting structures (structure 126 that holds driver 50 and structure 128 that holds driver 52 can be seen in the drawing). These individual driver mounting structures may be coupled to line array loudspeaker housing structure 119. Note that FIGS. 4A and 4B disclose only one of many possible alternative manners by which the drivers may be held in an array, with a fixed articulation angle between interleaved drivers FIG. 5 illustrates line array loudspeaker 150. Line array loudspeaker 150 includes sixteen drivers arranged generally vertically, as shown. Loudspeaker housing 158 holds the drivers in place. Electronics in lower support module 156 provide controlled, amplified audio signals to each driver. Line array loudspeaker 150 has a first group of drivers 152 that includes in this non-limiting example twelve interleaved acoustic drivers. Group 152 includes six acoustic drivers 160-165, each comprising an axis (not shown). As described above relative to FIGS. 3, 4A and 4B, drivers 160-165 are arranged so that their axes are parallel. Group 152 also includes six other drivers 170-175 that are interleaved with drivers 160-165. Each of drivers 170-175 also comprises an axis (not shown). As described above relative to FIGS. 3, 4A and 4B, drivers 170-175 are arranged so that their axes are parallel. Drivers 160-165 and 170-175 are arranged such that a projection onto an azimuth plane of the axes of the drivers 160-165 intersects with a projection onto the azimuth plane of the axes of the drivers 170-175 at a fixed articulation angle (which in this non-limiting example is 42 degrees).

Second group 154 of acoustic drivers 180-183 is adjacent to first group of drivers 152. The second group comprises a plurality of acoustic drivers each comprising an axis. In this non-limiting example, there are four drivers 180-183 in group 154. The drivers of the second group are arranged such that a projection onto the azimuth plane of the axes of the drivers of the second group intersect at varied articulation angles. The second group of drivers may have (but need not have) articulation angles that are less than the articulation angles of the first group. In this example, group 154 includes a first pair of drivers 180 and 181 that are closest to group 152 and are at an articulation angle of about 21 degrees, and a second pair of drivers that are immediately adjacent to the first pair of drivers 180 and 181 and are at an articulation angle of about 10 degrees. Because the articulation angles of the drivers of the second group of drivers is less than those of the first group, the drivers of the second group provide more consistent sound coverage in the near field, close to the line array. Also, especially for use in venues in which audience members can sit close to a stage, the second group of drivers can be pointed toward the front rows so as to provide good sound quality at an appropriate loudness.

FIG. 5 also illustrates a "J"-shaped line array, wherein all of the drivers of group 152 are arranged along a straight line, and the lowermost drivers (group 154) are arranged along a curved line such that they are all pointed slightly down from the horizontal. As described elsewhere herein, the drivers of group 154 provide better sound coverage to listeners close to and below line array loudspeaker 150.

Figure 6:
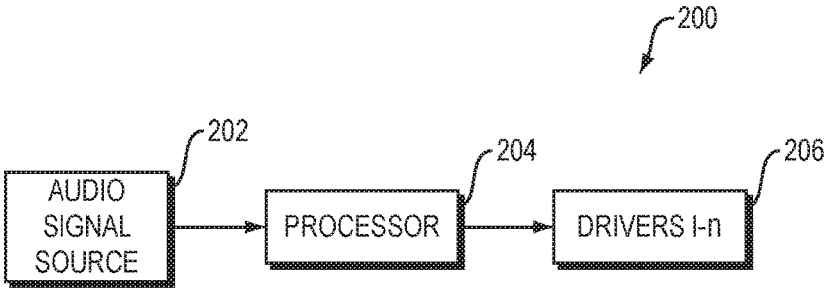
FIG. 6 is a schematic diagram of a line array loudspeaker.

FIG. 6 is a functional block diagram of only aspects of line array loudspeaker 200 that are involved in its operation as described herein. Audio signal source 202 provides audio signals that are reproduced by the multiple drivers of the line array, labelled drivers 1-n (block 206). Processor 204 is enabled to act on the audio signals to accomplish a desired result. For example, processor 204 can implement software that is executed on the processor to cause the amplitude and/or phase of one or more drivers to change. In one example, the sound coverage pattern of a vertical line array loudspeaker can be altered. Steering in-line loudspeaker arrays is known in the art.

Figure 7A:
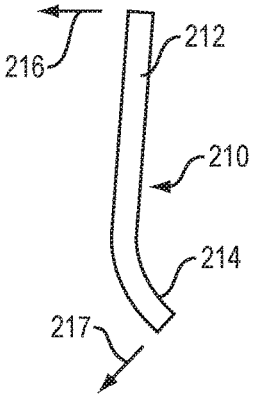
FIGS. 7A-7B are schematic side views of line array loudspeakers arranged in "J" configurations.
Figure 7B:
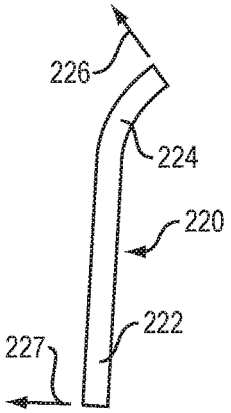
Figure 7C:
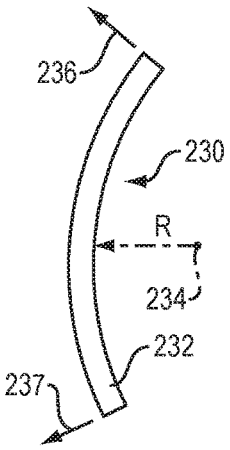
FIG. 7C is a schematic side view of a line array loudspeaker arranged in a "C" configuration.

FIGS. 7A-7D schematically depict several options of line array loudspeakers in which drivers are arranged along straight and/or curved lines. The drivers (not shown) are arranged such that some drivers are at fixed articulation angles and other drivers are at varied articulation angles. Line array loudspeaker 210, FIG. 7A, includes portion 212 that comprises a group of drivers (not shown) interleaved at a fixed articulation angle (such as shown in FIGS. 3, 4A, and 4B). Lower portion 214 of drivers is adjacent to portion 212 and includes a second group of drivers with varied articulation angles (such as shown in FIG. 5). The articulation angle can be considered to be the angle between the axes of two adjacent drivers, or perhaps of two drivers in a group of drivers (regardless of whether or not the two drivers are immediately adjacent each other). In portion 214 the articulation angle is not fixed. Rather, the articulation angle varies over the length of portion 214. As one non-limiting example of a line array loudspeaker configured as shown in FIG. 7A, the fixed articulation angle in portion 212 can be 42 degrees. That is, the angle between the axes of drivers in portion 212 that are pointed in different directions is 42 degrees. In portion 214, the two drivers closest to portion 212 are at a 21 degree articulation angle and the next (and last) two drivers are at a 10 degree articulation angle. There can be more or fewer drivers in portion 214, and the variation in articulation angles in portion 214 can be as desired. For example, there can be two or more different articulation angles accomplished in the group. Also, articulation can be between drivers that are not immediately adjacent to one another.

One result of having two pairs of drivers at the lowermost extent of the line array that have articulation angles that are less than the fixed articulation angle in portion 212 is that listeners in the near field and who are not located in the very wings of a theater (i.e., are close to the location of the line array) will receive sound that is blended from at least two drivers, and of good magnitude. Also, having the narrowest articulation angle at the very bottom of the line array helps ensure these same results for listeners seated closest to the line array.

The "J" shape curvature of line array 210 (where the top portion 212 is linear and the lowest portion 214 lies along a curved line, where the curve may or may not have a constant radius of curvature) creates a general (but not literal) forward sound envelope bounded by arrows 216 and 217. If array 210 is located higher than the closest listeners (e.g., on an elevated stage that is located at the front of a performance venue), the partially downwardly-facing drivers in portion 214 help project sound down to people in the front rows or close to the stage, while the smaller articulation angle helps to prevent people seated in front of the line array from being located in a region that is only reached by sound from the peripheries of the sound envelopes of the drivers, which can have an effect on magnitude.

For situations with essentially the opposite problem related to listeners (i.e., where there are listeners that are above the top sound envelope boundary 216), the top portion of the array can be curved backward to expand the angular extent of the sound envelope. An example is depicted in line array 220, FIG. 7B. A sound envelope bounded by arrows 226 and 227 can be created with an array comprising linear portion 222 and curved portion 224, forming a "J" shape but with the curve at the top. An envelope with an even greater included angle (bounded by arrows 236 and 237) can be created by arranging the entire array along a convexly curved line, as depicted by array 320, FIG. 7C, wherein the drivers are all in portion 232 and wherein the drivers are arranged in a "C" shape that has a constant (or at least generally constant) radius of curvature R from center point 234.

Figure 7D:
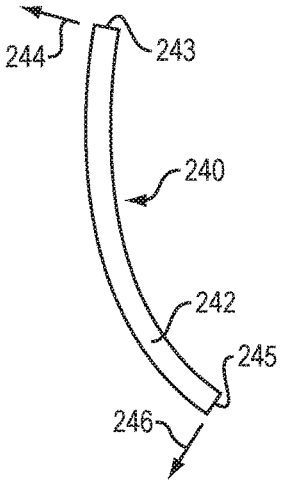
FIG. 7D is a schematic side view of a line array loudspeaker arranged in a "spiral" configuration.

Another arrangement places some or all of the drivers along one or more lines curved in other ways. One non-limiting example is depicted in FIG. 7D, wherein driver array 240 comprises a spiral array of a type known in the art, which can develop a sound envelope bounded by arrow 244 at the top 243 of array 242 and arrow 246 at the bottom 245 of the array. There are many types of spiral arrays that provide various rates of curvature of a line along which the drivers are located. Generally, in a spiral array the drivers are arranged along a continuous curve, wherein the curvature increases with distance along the curve; there is no straight section as there is in a "J" line array. Thus, in this non-limiting example the curvature at the top 243 is very slight (perhaps one degree) and increases to the bottom 245. The curvature may (or may not) change at predetermined intervals along the length of the array. As one non-limiting example, an arithmetic spiral is one for which the angle between successive loudspeakers along the length of the array changes by a predetermined angle.

Note that line array loudspeakers typically (but not necessarily) comprise a generally vertical array with only one driver at each height. Thus the drivers can be described as having their axes fall on a line that is generally vertical, where the line may be straight or curved.

In another example, some or all of the drivers are held in the housing in a manner that allows the directions of their axes to be changed, i.e., the drivers can be moved slightly, to change their axis angle relative to the horizontal. Examples include arrays where the top and/or bottom of the array can be pushed in or out, to form both types of J curves or a C curve. Such flexible line array loudspeaker systems are known in the field and are exemplified by the Bose® F1 Model 812 flexible array loudspeaker system available from Bose Corporation, Framingham, Mass., USA.

Elements of FIG. 6 are shown and described as discrete elements in a block diagram. These may be implemented as one or more of analog circuitry or digital circuitry. Alternatively, or additionally, they may be implemented with one or more microprocessors (e.g., processor 204) executing software instructions. The software instructions can include digital signal processing instructions. Operations may be performed by analog circuitry or by a microprocessor executing software that performs the equivalent of the analog operation. Signal lines may be implemented as discrete analog or digital signal lines, as a discrete digital signal line with appropriate signal processing that is able to process separate signals, and/or as elements of a wireless communication system.

When processes are represented or implied in the block diagram, the steps may be performed by one element or a plurality of elements. The steps may be performed together or at different times. The elements that perform the activities may be physically the same or proximate one another, or may be physically separate. One element may perform the actions of more than one block. Audio signals may be encoded or not, and may be transmitted in either digital or analog form. Conventional audio signal processing equipment and operations are in some cases omitted from the drawing.

Examples of the systems and methods described herein comprise computer components and computer-implemented steps that will be apparent to those skilled in the art. For example, it should be understood by one of skill in the art that the computer-implemented steps may be stored as computer-executable instructions on a computer-readable medium such as, for example, floppy disks, hard disks, optical disks, Flash ROMS, nonvolatile ROM, and RAM. Furthermore, it should be understood by one of skill in the art that the computer-executable instructions may be executed on a variety of processors such as, for example, microprocessors, digital signal processors, gate arrays, etc. For ease of exposition, not every step or element of the systems and methods described above is described herein as part of a computer system, but those skilled in the art will recognize that each step or element may have a corresponding computer system or software component. Such computer system and/or software components are therefore enabled by describing their corresponding steps or elements (that is, their functionality), and are within the scope of the disclosure.

A number of implementations have been described. Nevertheless, it will be understood that additional modifications may be made without departing from the scope of the inventive concepts described herein, and, accordingly, other examples are within the scope of the following claims.

What is claimed is:

1. A line array loudspeaker, comprising:

a first group of acoustic drivers comprising a first plurality of acoustic drivers each comprising an axis, the first plurality of acoustic drivers arranged so that their axes are parallel, and a second plurality of acoustic drivers each comprising an axis, the second plurality of acoustic drivers arranged so that their axes are parallel, wherein the first and second plurality of acoustic drivers are arranged such that a projection onto an azimuth plane of the axes of the first plurality of acoustic drivers intersects with a projection onto the azimuth plane of the axes of the second plurality of acoustic drivers at a first, fixed articulation angle; and a second group of acoustic drivers, the second group adjacent to the first group and comprising a third plurality of acoustic drivers each comprising an axis, wherein a projection onto the azimuth plane of the axes of the third plurality of acoustic drivers intersect at varied articulation angles, wherein the projections onto the azimuth plane of the axes of a first pair of acoustic drivers of the second group of acoustic drivers intersect at a second articulation angle that is different than the first articulation angle, wherein the projections onto the azimuth plane of the axes of a second pair of acoustic drivers of the second group of acoustic drivers intersect at a third articulation angle that is different than both the first and second articulation angles, and wherein the first pair of acoustic drivers of the second group of acoustic drivers are the closest acoustic drivers of the second group to the first group.

2. The line array loudspeaker of claim 1, wherein the first and second plurality of acoustic drivers are interleaved along a length of the first group of acoustic drivers.

3. The line array loudspeaker of claim 1, wherein the second articulation angle is less than the first articulation angle.

4. The line array loudspeaker of claim 1, wherein the second pair of acoustic drivers of the second group of acoustic drivers is adjacent to the first pair of acoustic drivers of the second group of acoustic drivers.

5. The line array loudspeaker of claim 4, wherein the third articulation angle is less than both the first and second articulation angles.

6. The line array loudspeaker of claim 1, wherein the second group of acoustic drivers are arranged along a curved line.

7. The line array loudspeaker of claim 6, wherein the curved line has a constant radius of curvature.

8. The line array loudspeaker of claim 6, wherein the first group of acoustic drivers is arranged along the same curved line as is the second group of acoustic drivers.

9. The line array loudspeaker of claim 8, wherein the curved line is continuously curved.

10. The line array loudspeaker of claim 9, wherein the curvature increases continuously along an entire length of the line array.

11. The line array loudspeaker of claim 1, wherein at least some of the acoustic drivers of the first and second groups of acoustic drivers are configured to be positioned such that an angle of their axes relative to horizontal can be changed.

12. The line array loudspeaker of claim 1, wherein the axes of the first plurality of acoustic drivers are coplanar in a first plane and the axes of the second plurality of acoustic drivers are coplanar in a second plane, wherein the first and second planes intersect at a plane intersection angle.

13. The line array loudspeaker of claim 12, wherein the plane intersection angle is an acute angle.

14. The line array loudspeaker of claim 1, wherein the acoustic drivers are each configured to output sound with an amplitude and phase, and wherein the line array loudspeaker further comprises a processor that is configured to alter at least one of the amplitude and phase of the sound from a plurality of the acoustic drivers.

15. A line array loudspeaker, comprising:

a first group of acoustic drivers comprising a first plurality of acoustic drivers each comprising an axis, the first plurality of acoustic drivers arranged so that their axes are parallel, and a second plurality of acoustic drivers each comprising an axis, the second plurality of acoustic drivers arranged so that their axes are parallel, wherein the first and second plurality of acoustic drivers are arranged such that a projection onto an azimuth plane of the axes of the first plurality of acoustic drivers intersects with a projection onto the azimuth plane of the axes of the second plurality of acoustic drivers at a first, fixed articulation angle, and wherein the first and second plurality of acoustic drivers are interleaved along a length of the first group of acoustic drivers; and a second group of acoustic drivers, the second group adjacent to the first group and comprising a third plurality of acoustic drivers each comprising an axis, wherein a projection onto the azimuth plane of the axes of the third plurality of acoustic drivers intersect at varied articulation angles, wherein the projections onto the azimuth plane of the axes of a first pair of acoustic drivers of the second group of acoustic drivers intersect at a second articulation angle that is less than the first articulation angle, and the projections onto the azimuth plane of the axes of a second pair of acoustic drivers of the second group of acoustic drivers intersect at a third articulation angle that is less than both the first and second articulation angles, wherein the first pair of acoustic drivers of the second group of acoustic drivers are the closest acoustic drivers of the second group to the first group and the second pair of acoustic drivers of the second group of acoustic drivers is adjacent to the first pair of acoustic drivers of the second group of acoustic drivers.

16. The line array loudspeaker of claim 15, wherein the second group of acoustic drivers are arranged along a curved line that has a constant radius of curvature.

17. The line array loudspeaker of claim 16, wherein the first group of acoustic drivers is arranged along a straight line.

* * * * *